United States Patent [19]

Levene et al.

[11] 4,220,118

[45] Sep. 2, 1980

[54] SPRAY HOOD

[75] Inventors: Leon Levene, Thornhill; R. Wayne McClung, Cambridge, both of Canada

[73] Assignee: Domglas Inc., Mississauga, Canada

[21] Appl. No.: 934,131

[22] Filed: Aug. 15, 1978

[51] Int. Cl.[2] ..... B05C 19/02; C23C 11/00

[52] U.S. Cl. ..... 118/720; 118/729

[58] Field of Search ..... 118/48, 720, 729, 326

[56] References Cited

FOREIGN PATENT DOCUMENTS 873818 6/1971 Canada .

OTHER PUBLICATIONS

Chugoku Marine Paints, 1–73.

*Primary Examiner*—Bernard D. Pianalto

*Attorney, Agent, or Firm*—Rogers, Bereskin & Parr

[57] ABSTRACT

A spray hood is provided for use in coating glassware such as bottles. The hood defines a tunnel for straddling a conveyor and has baffles on walls of the tunnel for adjustment horizontally and vertically to define a space about at least lower parts of the glassware where coating is to be sprayed. A coating supply system is coupled to the walls for spraying in the space and includes nozzles in two groups: one group on one side near an entrance end of the tunnel; and the other group on the other side near an exit end of the tunnel.

6 Claims, 4 Drawing Figures

SPRAY HOOD

This invention relates to spray hoods for use in coating glassware and more particularly for spraying tin tetrachloride on bottles.

The present invention will be described with particular reference to a spray hood used to spray side wall portions of bottles using a gas-borne tin tetrachloride vapour. However the invention is applicable to the application of sprayed materials on glassware generally.

It is well known that the strength of glassware is reduced considerably by scratches on the surfaces of the glassware. Because of this glassware products have maximum strength just after manufacture and before use. This is particularly true of glass containers which contain beverages. Such containers undergo a series of operations including filling and capping and during these operations the containers rub against one another and against parts of handling machinery. This results inevitably in scratching of the container and consequently the wall of an untreated container must be sufficiently thick to withstand breaking forces after the wall has been scratched.

Surface treatments are available to enhance the scratch resistance of glass so that the wall thickness can be reduced while maintaining the same resistance to breakage. A typical surface treatment is to spray gas-borne tin tetrachloride vapour on that part of the bottle below the neck where damage is likely to occur. It is undesirable and unnecessary to coat the neck and because of the cost of the tin tetrachloride it is preferable to coat only those parts where damage is likely to occur. Further, for the same reason it is desirable that the amount of tin tetrachloride vapour exhausted from the coating process be kept to a minimum.

A further consideration in designing a spray hood is to provide an arrangement which will spray the tin tetrachloride evenly over that part of the bottle which is to be coated. One of the problems in the art is that the spray tends to accumulate on parts of the bottle nearest to the spray and to be less evenly deposited on other parts of the bottle.

Present spray hoods generally consist of a tunnel having a nozzle in each of the sides of the tunnel for spraying gas-borne tin tetrachloride vapour. The nozzles are directed towards bottles passing through the tunnel and the resulting deposit tends to be uneven. Also there is a great waste of tin tetrachloride which is exhausted through an outlet exhaust positioned on the top of the tunnel. It has been suggested that an improvement can be made by exhausting the waste vapour from ends of the tunnel thereby causing a flow of vapour along the tunnel and around the bottles as they travel toward an exit end of the tunnel. While this latter arrangement has resulted in some improvement in the distribution of the deposit on the bottles, there continues to be a significant loss of tin tetrachloride through the exhaust system.

The present trends towards controlling pollutants in industrial processes and reducing energy usage have also become factors in the design of spray hoods. Exhaust leaving the spray hood is heavily contaminated with tin tetrachloride and must be disposed of either by collection (which at the present time is not very practical) or more commonly by exhaust into the atmosphere. In any event it is desirable to limit the amount of tin tetrachloride which is not deposited on the bottles during the process and ideally all of the vapour from the nozzles would be deposited on the bottles. For these reasons the present invention is directed towards providing a spray hood which is more efficient than those presently available and which reduces the percentage of spray material finding its way to the exhaust outlet from the spray hood.

Accordingly in one of its aspects the present invention provides a spray hood for use in coating glassware such as bottles. This spray hood includes means defining a tunnel structure having an entrance end and an exit end and adapted to straddle a longitudinally extending conveyor carrying the glassware horizontally so that the glassware will be moved through the tunnel. The tunnel has upright first and second side walls and a top extending between the side walls. First and second baffle assemblies are attached to the respective first and second side walls inside the tunnel and the assemblies include vertical and horizontal adjustment means to permit moving the baffle assemblies to accommodate below the baffle assemblies that portion of the glassware to be coated and to give the baffle assemblies whatever horizontal separation is necessary to permit the passage of the glassware through the tunnel. A coating supply system is coupled to the first and second side walls for supplying a gas-borne vapour of the coating material into the tunnel at levels below the baffle assemblies. Exhaust manifolds are located at both the entrance and exit ends of the tunnel to collect excess gas-born coating vapour to thereby draw this vapour about the glassware as the vapour passes from the coating supply system to the exhaust manifold to deposit the coating material on the glassware.

In another of its aspects the invention provides a spray hood for use in coating glasswares such as bottles and having means defining a tunnel structure. This structure has an entrance end and an exit end and is adapted to straddle a longitudinally extending conveyor carrying the glassware horizontally so that the glassware will be moved through the tunnel. The tunnel has upright first and second side walls and a top extending between the side walls and a coating supply system is coupled to the first and second side walls. This system supplies gas-born vapour of the coating material into the tunnel and the coating supply system includes two groups of nozzles coupled to the respective first and second side walls for directing the coating material towards the glassware. The nozzles in the first of the groups are positioned towards the entrance end and the nozzles in the other of the groups are positioned towards the exit end. Exhaust manifolds are located at both the entrance and exit ends of the tunnel to collect excess gas-borne coating vapour to thereby draw this vapour about the glassware as the vapour passes from the coating supply system to the exhaust manifold to deposit the coating material on the glassware.

These and other aspects of the invention will be better understood with reference to the drawings, in which.

Figure 1:
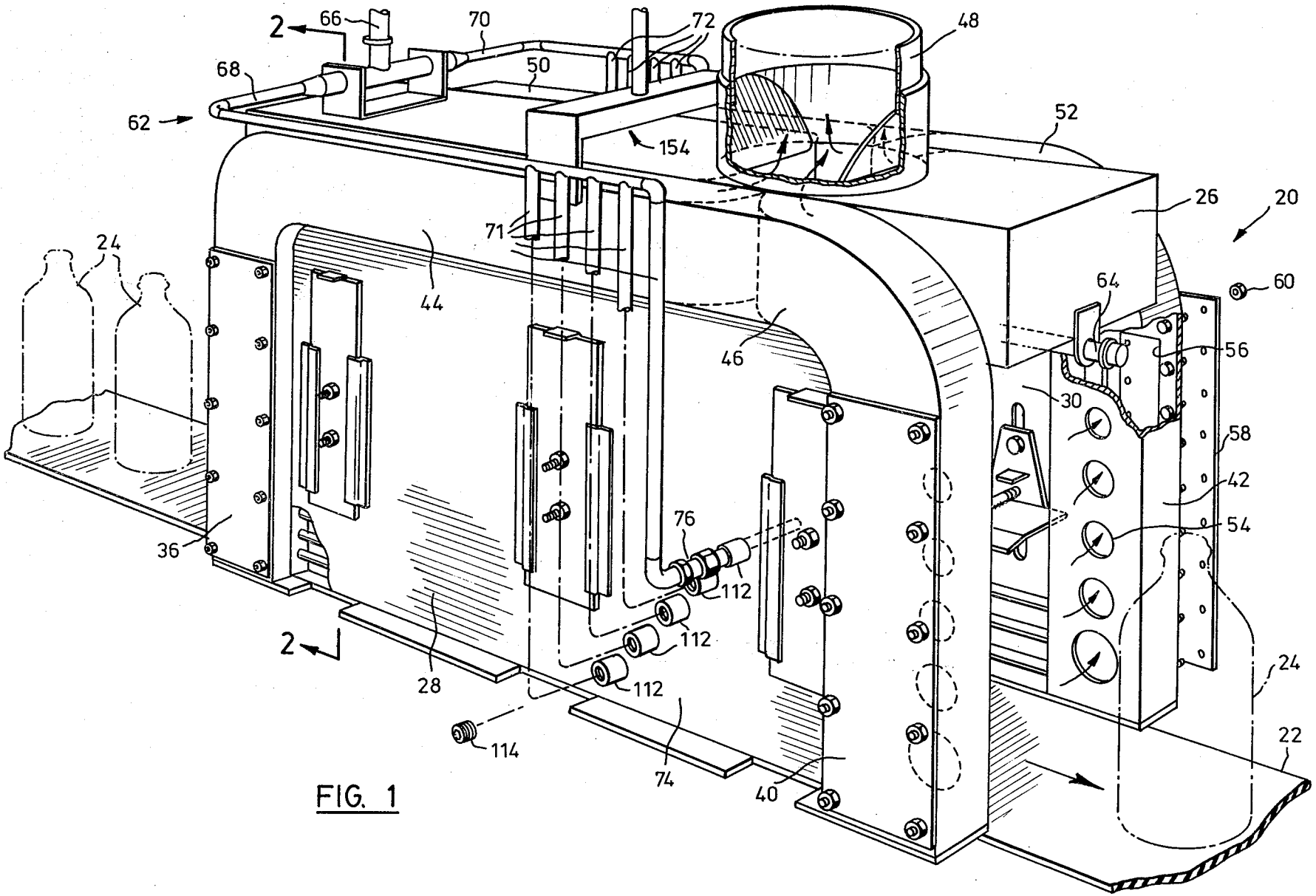
FIG. 1 is a perspective view of a preferred embodiment of a spray hood according to the invention and having parts broken away to show internal structure, the spray hood being positioned on a conveyor carrying exemplary bottles shown in ghost outline.

Reference is first made to FIG. 1 which shows a spray hood designated generally by the numeral 20 straddling a conveyor 22 carrying exemplary bottles 24. The bottles are spaced on the conveyor and pass through the spray hood where they are coated on portions below the neck as will be described.

Figure 2:
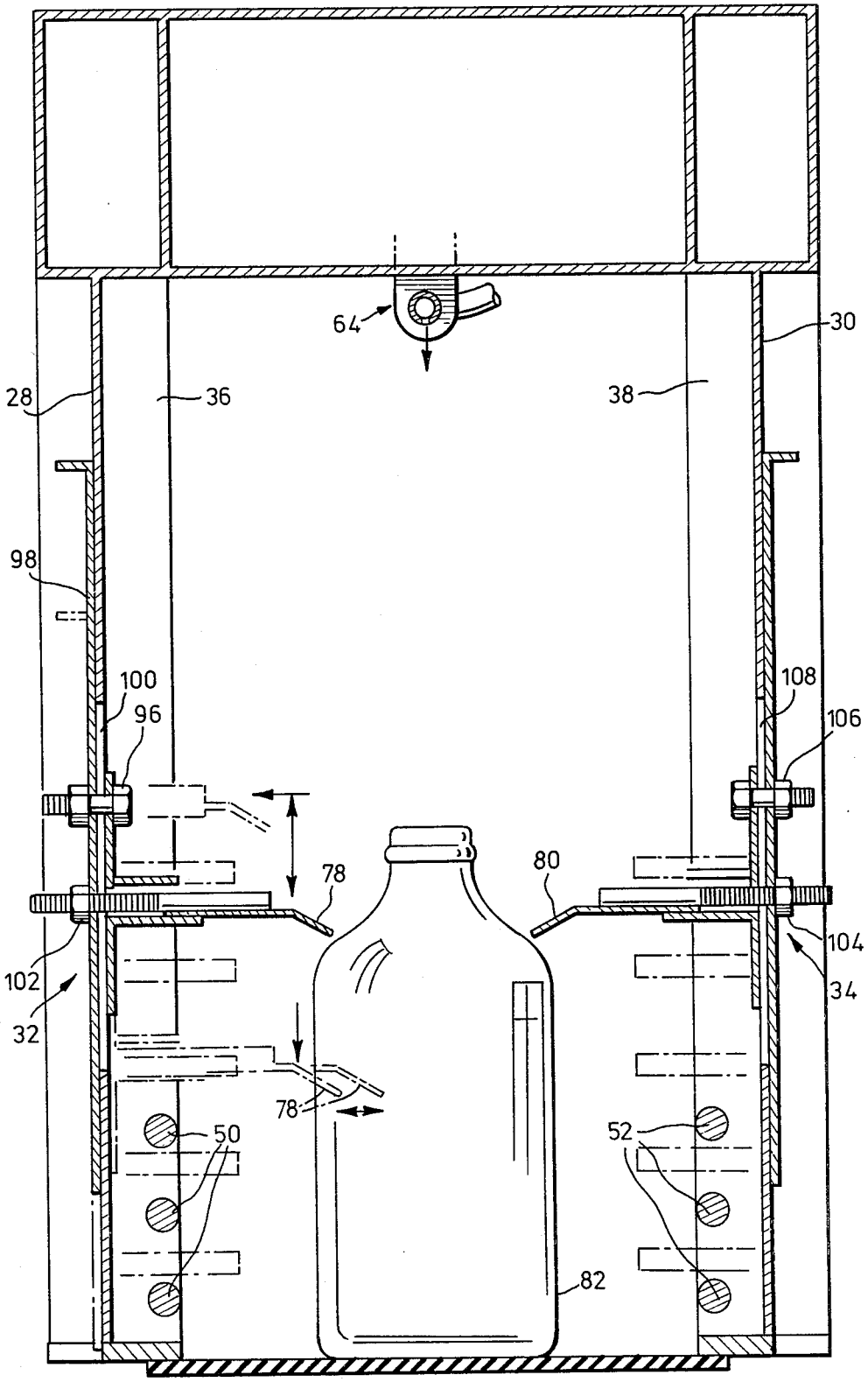
FIG. 2 is a sectional view on line 2—2 of FIG. 1.

The spray hood 20 effectively defines a tunnel above the conveyor 22 and includes a box-section top 26 and first and second side walls 28, 30. As also seen in FIG. 2, the side walls 28, 30 support respective baffle assemblies 32, 34 and terminate at an entrance end of the spray hood 20 in respective exhaust manifolds 36, 38 and at an exit end of the tunnel in manifolds 40, 42. The top of side wall 28 terminates in a duct 44 leading from manifold 36 and in a shorter duct 46 leading from manifold 40. The ducts 44, 46 lead exhaust from the manifolds 36, 40 to an exhaust outlet assembly 48. Similarly, ducts 50, 52 lead from manifolds 38, 42 to the exhaust outlet assembly 48.

As seen in FIGS. 1 and 2, the manifolds 36, 38 and 40, 42 project inwardly of the side wall 28 and guard rails 50, 52 extend between manifolds 36, 40 and 38, 42 to ensure that no bottles will fall and engage the manifolds thereby blocking the passage of other bottles through the tunnel.

The exhaust manifold 42 seen in FIG. 1 is typical of all four manifolds and defines a series of openings 54 which are of decreasing diameter towards the top of the manifold. On the outside, the manifold defines an elongate opening 56 for servicing and cleaning the manifold and this opening is normally closed by a cover plate 58 attached by suitable fasteners 60.

There are two supplies to the spray hood. Firstly a coating material supply system shown generally by the numeral 62 and secondly an air supply system feeding an air inlet manifold 64 attached to the underside of the top 26.

The coating material supply system 62 receives gas-borne coating material vapour through an inlet pipe 66 which leads to a pair of connecting pipes 68, 70. These pipes respectively feed nozzle connecting pipes 71 and 72 leading to groups of nozzles: the pipes 71 lead to a group designated generally by the numeral 74; and the pipes 72 lead to a further group on the opposite side of the spray hood.

The group of nozzles associated with pipes 72 lies adjacent the entrance end of the spray hood whereas the group 74 lies adjacent the exit end. The location and arrangement of the nozzles in these groups will be described more fully with reference to FIG. 4. For the moment, it will be seen from FIG. 1 that a typical nozzle 76 receives gas-borne vapour from an associated pipe 71 and directs this vapour into the tunnel at a particular level with reference to the conveyor 22.

Returning to the air inlet manifold 64, this manifold extends throughout the length of the tunnel and defines small openings to permit the flow of air downwardly from the manifold. Again the arrangement and connection of this manifold will be described more fully with reference to FIG. 4.

As seen in FIGS. 1 and 2, the baffle assemblies 32, 34 include respective baffle plates 78, 80 which in FIG. 2 are positioned adjacent a bottle 82 so that the neck of the bottle projects above these plates whereas the part to be coated is below the plates. Consequently when vapour is sprayed into the tunnel below the plates there will be a tendency for the vapour to remain in this part of the tunnel and to find its way towards the exhaust manifolds at the entrance end and exit end of the tunnel. Air from the air inlet manifold 64 will form a slight positive pressure above the plates 78, 80 to thereby reduce the possibility of losing vapour by flow upwardly between the plates in spaces between the bottles.

It will be appreciated that the spray hood should be capable of accepting bottles of different sizes. Consequently the baffle assembly 32, 34 are made to provide adjustment for the plates 78, 80 both horizontally for different diameters or widths of bottles and also vertically for different heights of bottles. In an extreme situation where it is desired to coat the whole of the bottle or other similar article the plates can be brought together and the article will pass under the plates.

Figures 3, 4:
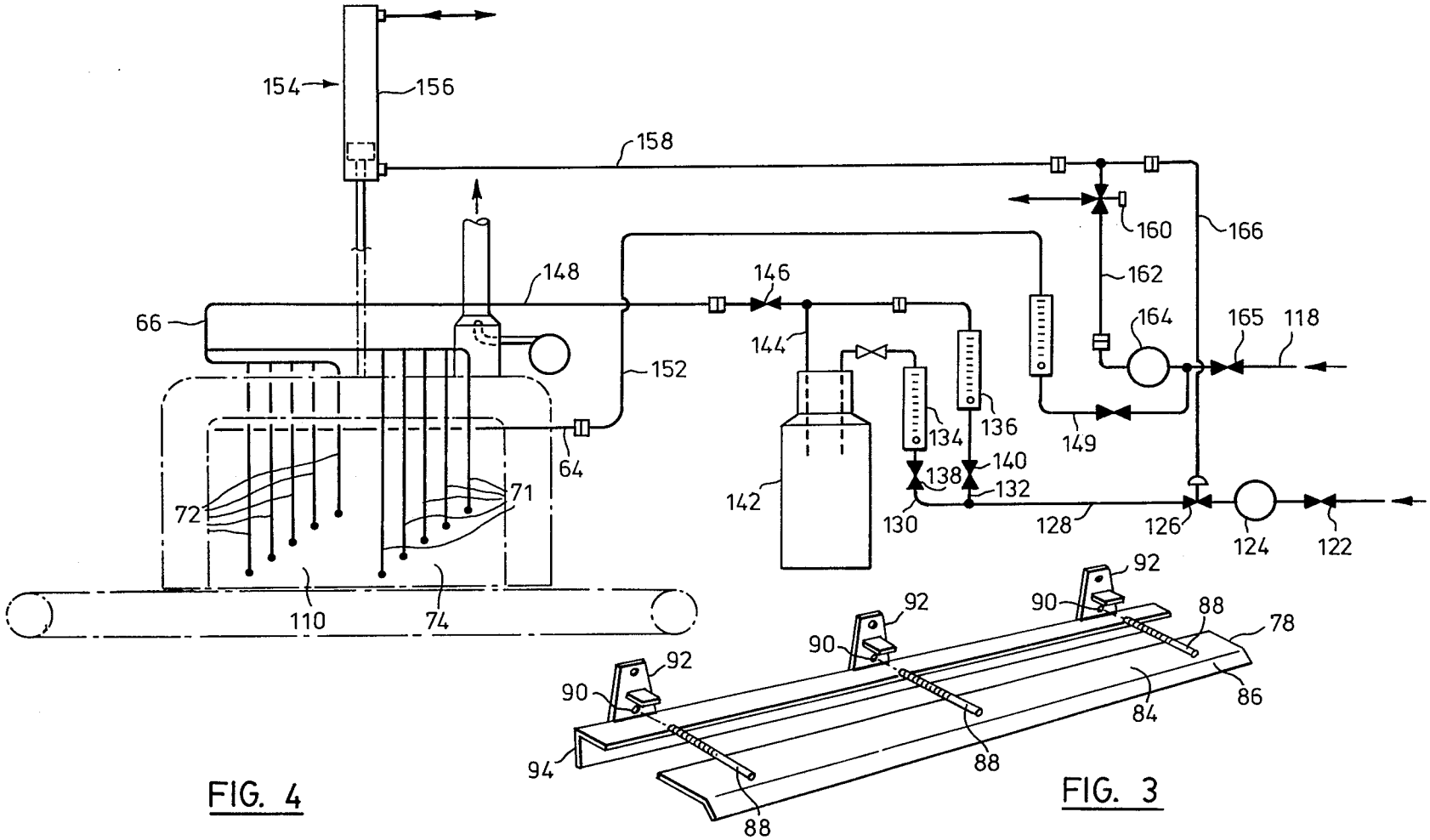
FIG. 3 is an exploded perspective view of parts of a baffle assembly which is incorporated in the spray hood.
FIG. 4 is a schematic view showing how the spray hood would be connected to supply systems.

As seen in FIGS. 2 and 3, plate 78 includes a main portion 84 and a downwardly inclined inner portion 86. This latter portion is inclined in this manner to cause some deflection of vapour as the vapour flows towards the centre of the tunnel to reduce the risk of vapour flowing upwardly. The main portion 84 is attached to three threaded rods 88 which are adapted to engage through openings 90 in respective brackets 92 attached to a support element 94. As seen in FIG. 2, this element is attached by fasteners 96 to a carrier plate 98 on the outside of the wall 28 and the fastener 96 lies in a slot 100 in this side wall.

The baffle plates 78, 80 can be adjusted horizontally with reference to the respective side walls, 28, 30 from outside the hood using location nuts 102, 104 and vertical adjustment is possible by releasing the fastener 96 and the corresponding fastener 106 to slide the fasteners in the slots 100 and corresponding slots 108. Some of the possible positions for the baffle assembly are shown both in solid outline and in ghost outline.

Reference is next made to FIGS. 1 and 4 to describe the locations of one group of nozzles 74 on side wall 28 and of a corresponding group of nozzles 110 associated with nozzle supply pipes 72 and attached to side wall 30. As seen in FIG. 1, nozzles such as nozzle 76 are engaged in threaded sleeves 112 attached to side wall 28 and these sleeves can be sealed using plugs such as a plug 114 also shown in FIG. 1. The sleeves 112 are positioned at different heights spaced from the bottom of the wall 28 and located nearer the exit end of the tunnel. Also each sleeve is nearer the exit end than the sleeve below it so that the resulting spray inside the tunnel is staggered both with reference to the length of the tunnel and with reference to the height of the tunnel. Similarly, the group of nozzles 110 is engaged in side wall 30 in a similar fashion to nozzles 76 and the nozzles are staggered in the same fashion, i.e. each nozzle is nearer the exit end than the nozzle below. However this group of nozzles is nearer the entrance end of the tunnel than the group of nozzles 74.

As seen in FIG. 4 there are two air supplies 118, 120. The air supply 120 has been dried and passes through a valve 122, regulator 124 and an isolation valve 126 which is responsive to pressure downstream from supply 118 to close the valve (as will be described).

Air supply 120 feeds a pipe 128 which feeds two pipes 130, 132. These latter pipes respectively lead air through control valves 138, 140 and through flow meters 134, 136. Air from pipe 130 is fed into a container 142 of tin tetrachloride and picks up vapour before flowing through outlet pipe 144 to mix with air from pipe 132. The resulting air-borne vapour is then passed through a shut off valve 146 and then by way of a further pipe 148 to inlet pipe 66 (see also FIG. 1). The vapour is then fed by nozzle connecting pipes 71, 72, to groups of nozzles 74 and 110.

Air is also fed through air supply 118 and passes by way of a pipe 149 through a control valve 151 and flow meter 150 and then by way of another pipe 152 to the manifold 64 (see also FIG. 1).

Air from supply 118 is also used to drive a pneumatic lifting device 154 attached to the top of the spray hood 20 as shown in FIG. 1. This device consists of a pneumatic actuator 156 which is vented at the top and receives air from a pipe 158 at the bottom. This pipe leads from a valve 160 which is connected by a pipe 162 to a regulator 164 and then to a valve 165 on air supply 118. The pipe 158 is also connected by a pipe 166 to a control valve 126 such that when air pressure is available in pipe 158 the valve 126 is closed as will be described.

In use the valves 122, 165 are opened and the regulators 124, 164 are set to provide respective predetermined pressures of about 30 and 70 pounds per square inch. Normally air will flow through valve 126 and into pipe 128 before passing through the flow meters 134, 136. The flow through these meters is controlled by valves 138, 140 and when the system is idle vapour is retained in container 142 by shut off valve 146.

Air flow also takes place to the air manifold 64 as controlled by valve 151 and metered by flow meter 150.

In the event that the spray hood is to be elevated for some reason, the valve 160 is moved from a closed position in which the pipe 162 is blocked and the pipe 158 is vented to atmosphere, to an open position in which air flows through the valve towards the actuator 156. At the same time air pressure builds up in pipe 166 to close valve 126 and to thereby discontinue spraying. When the spray hood is to be lowered the valve 160 is returned to the closed position so that the pipes 158 and 166 are again vented. The hood will come down under its own weight dampened by the controlled flow of air back out through pipe 158 and valve 160. This relief in pressure allows valve 126 to open and the spraying commences again.

Before commencing the coating operation the hood is adjusted to suit the glassware being coated. For shorter glassware it may be necessary to remove some of the upper nozzles 76 and corresponding nozzles on the other side of the hood to permit adjusting the baffle assemblies downwardly. The corresponding sleeves 112 etc. will be sealed using plugs such as plug 114 and ends of the related pipes 71, 72 will be sealed using suitable caps (not shown).

The baffle assemblies are then adjusted both vertically and horizontally depending upon the shape and size of the glassware and the areas to be coated. The hood is then ready to commence coating and as the nozzles and air supply to manifold 64 are activated a fog of spray will envelope the part of the glassware to be coated and the glassware will travel in this fog through the hood. Unused spray still in the form of a fog will be collected by the exhaust system as previously explained.

It has been found in tests that the present spray hood used with a tin tetrachloride spray has resulted in savings of between 10 and 25 percent of the tin tetrachloride. Further a superior coating distribution was achieved as well as a most satisfactory thickness of coating.

It will be apparent from the foregoing description that the preferred embodiment can be varied within the scope of the invention. The air system could be replaced by a suitable neutral gas system although air obviously is the most convenient gas to use. Also the details of the structure of the hood could be varied consistent with providing a tunnel for the bottles or glassware generally. Overall the preferred embodiment is exemplary of many other embodiments within the scope of the invention in its various aspects.

What we claim as our invention is:

1. A spray hood for use in coating glassware, such as bottles, the spray hood comprising:

means defining a tunnel having an entrance end and and an exit end and adapted to straddle a conveyor carrying glassware for movement in a generally horizontal coating path through the tunnel, the tunnel having upright first and second side walls and a top extending between the side walls;

first and second baffle assemblies disposed inside the tunnel and including respective first and second baffle means extending inwardly from said side walls of the tunnel, and means permitting vertical and horizontal adjustment of the baffle means to accommodate therebelow, portions of the glassware to be coated and allow passage of the glassware through the tunnel;

a coating supply system coupled to said first and second side walls of the tunnel for supplying a gas-borne vapour of coating material into the tunnel below the baffle assemblies;

a first pair of exhaust manifolds located at the entrance end of the tunnel on respectively opposite sides of said coating path, and a second pair of exhaust manifolds located on respectively opposite sides of said path at the exit end of the tunnel, said manifolds including intake openings through which excess gas-borne coating vapour can be drawn into said manifolds, said intake openings being disposed laterally of said coating path only and being dimensioned so that the intake opening area for each manifold is at a maximum adjacent a lower end of the manifold and progressively decreases in a direction away from said lower end, whereby gas-borne coating vapour introduced into said tunnel from the coating supply system in use is drawn about and deposited on said portions of the glassware below the baffle means as said vapour passes from the supply system to the exhaust manifolds, and a relatively high density of coating material vapour is maintained in lower portions of the tunnel and;

an inlet manifold extending into the tunnel and disposed above the baffle assemblies, said manifold being adapted to feed air into the tunnel to cause a positive pressure tending to prevent upward flow of coating material past the baffle assemblies.

2. A spray hood as claimed in claim 1, wherein each of said exhaust manifolds is provided with a plurality of intake openings arranged in a series extending vertically of the manifold, the openings in each said series being of a maximum diameter adjacent said lower end of the manifold and being of progressively decreasing diameter towards the opposite end of the manifold.

3. A spray hood as claimed in claim 1 in which the coating supply system includes two groups of nozzles coupled to the respective first and second side walls for directing the coating material towards the glassware.

4. A spray hood as claimed in claim 1 in which the coating supply system includes two groups of nozzles coupled to the respective first and second side walls for directing the coating material towards the glassware, the nozzles in a first of the groups being positioned towards said entrance end and the nozzles in the other of the groups being positioned towards said exit end.

5. A spray hood as claimed in claim 1 in which the coating supply system includes two groups of nozzles coupled to the respective first and second side walls for directing the coating material towards the glassware, the nozzles in a first of the groups being positioned towards said entrance end and the nozzles in the other of the groups being positioned towards said exit end, each of the nozzles in the groups being positioned at a height different from that of the other nozzles in that group.

6. A spray hood as claimed in claim 1 in which the coating supply system includes two groups of nozzles coupled to the respective first and second side walls for directing the coating material towards the glassware, the nozzles in a first of the groups being positioned towards said entrance end and the nozzles in the other of the groups being positioned towards said exit end, each of the nozzles in the groups being positioned at a height different from that of the other nozzles in that group, and at a different longitudinal position with respect to the other nozzles in that group.

* * * * *